US007895832B2

(12) United States Patent
Gruber

(10) Patent No.: US 7,895,832 B2
(45) Date of Patent: Mar. 1, 2011

(54) PERFORMANCE EXHAUST SYSTEM

(75) Inventor: Erick L. Gruber, Rubicon, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 855 days.

(21) Appl. No.: 11/770,051

(22) Filed: Jun. 28, 2007

(65) Prior Publication Data

US 2009/0000282 A1 Jan. 1, 2009

(51) Int. Cl.
*F01N 3/10* (2006.01)

(52) U.S. Cl. ..... 60/299; 60/274; 60/312; 60/314; 60/322; 60/323; 181/227; 181/228; 181/255

(58) Field of Classification Search ..... 60/274, 60/305, 312, 313, 314, 322, 323, 324, 299; 181/212, 227, 228, 255
See application file for complete search history.

(56) References Cited

U.S. PATENT DOCUMENTS

| | | | | |
|---|---|---|---|---|
| 3,644,098 | A | 2/1972 | De Palma et al. | |
| 3,968,645 | A | 7/1976 | Noguchi et al. | |
| 3,981,145 | A | 9/1976 | Noguchi et al. | |
| 4,094,644 | A | 6/1978 | Wagner | |
| 4,172,508 | A | 10/1979 | Moss et al. | |
| 4,535,746 | A | 8/1985 | Otani et al. | |
| 4,848,294 | A | 7/1989 | Yamamoto | |
| 5,881,554 | A * | 3/1999 | Novak et al. | 60/302 |
| 6,155,044 | A * | 12/2000 | Kaiho et al. | 60/297 |
| 6,382,347 | B1 * | 5/2002 | Gerber | 181/227 |
| 6,732,509 | B2 * | 5/2004 | Shiga | 60/312 |
| 6,755,279 | B2 * | 6/2004 | Kaneko et al. | 181/232 |
| 7,426,980 | B2 * | 9/2008 | Bassani | 181/238 |
| 2005/0161283 | A1 | 7/2005 | Emler | |
| 2005/0284141 | A1 | 12/2005 | Yamaguchi et al. | |

FOREIGN PATENT DOCUMENTS

| | | |
|---|---|---|
| JP | 58023213 | 2/1983 |
| JP | 01083814 | 3/1989 |
| JP | 02221623 | 9/1990 |
| JP | 03054090 | 3/1991 |
| JP | 03235782 | 10/1991 |
| JP | 04011593 | 1/1992 |
| JP | 05086843 | 4/1993 |
| JP | 06298150 | 10/1994 |
| JP | 09053441 | 2/1997 |
| JP | 09195775 | 7/1997 |

(Continued)

*Primary Examiner*—Binh Q. Tran
(74) *Attorney, Agent, or Firm*—Michael Best & Friedrich LLP

(57) ABSTRACT

An exhaust system for a motorcycle engine including a header having an upstream end adjacent a combustion chamber of the engine and having a downstream end opposite the upstream end. The exhaust system includes a catalytic converter positioned downstream of the combustion chamber and configured to improve the emissions quality of exhaust gases discharged from the combustion chamber. The exhaust system further includes a perforated section at least partially defining an exhaust passageway, the perforated section disposed adjacent the downstream end of the header. A resonator chamber is in fluid communication with the perforated section. The resonator chamber is configured to allow expansion of the exhaust gases in the exhaust passageway through the perforated section.

19 Claims, 7 Drawing Sheets

FOREIGN PATENT DOCUMENTS

| | | | | |
|---|---|---|---|---|
| JP | 09264130 | | 10/1997 | |
| JP | 10141050 | * | 5/1998 | ..... 60/322 |
| JP | 10159537 | | 6/1998 | |
| JP | 11343895 | | 12/1999 | |
| JP | 2004003515 | | 1/2004 | |
| JP | 2004026007 | | 1/2004 | |

* cited by examiner

PERFORMANCE EXHAUST SYSTEM

BACKGROUND

The invention relates to an exhaust system including a catalytic converter for motorcycle engines.

SUMMARY

In one construction, the invention provides an exhaust system for a motorcycle engine including a header having an upstream end adjacent a combustion chamber of the engine and having a downstream end opposite the upstream end. The exhaust system includes a catalytic converter positioned downstream of the combustion chamber and configured to improve the emissions quality of exhaust gases discharged from the combustion chamber. The exhaust system further includes a perforated section at least partially defining an exhaust passageway, the perforated section disposed adjacent the downstream end of the header. A resonator chamber is in fluid communication with the perforated section, the resonator chamber configured to allow expansion of the exhaust gases in the exhaust passageway through the perforated section.

In another aspect, the invention provides a motorcycle including an engine and components of the exhaust system described above.

In yet another aspect, the invention provides a muffler assembly for use with an engine. The muffler assembly has an upstream end for receiving exhaust gases from one or more headers and a downstream end for expelling exhaust gases to the atmosphere. The muffler assembly includes a sound-muffling section adjacent the downstream end and a catalytic converter having a quantity of catalyst capable of improving the emissions quality of the exhaust gases from the engine. An exhaust conduit at least partially defines an exhaust passageway upstream of the catalytic converter, the exhaust conduit having one or more apertures. A resonator chamber is configured to allow volumetric expansion of the exhaust gases within the exhaust passageway, the resonator chamber in fluid communication with the one or more apertures. The catalytic converter is positioned at the upstream end of the muffler assembly.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
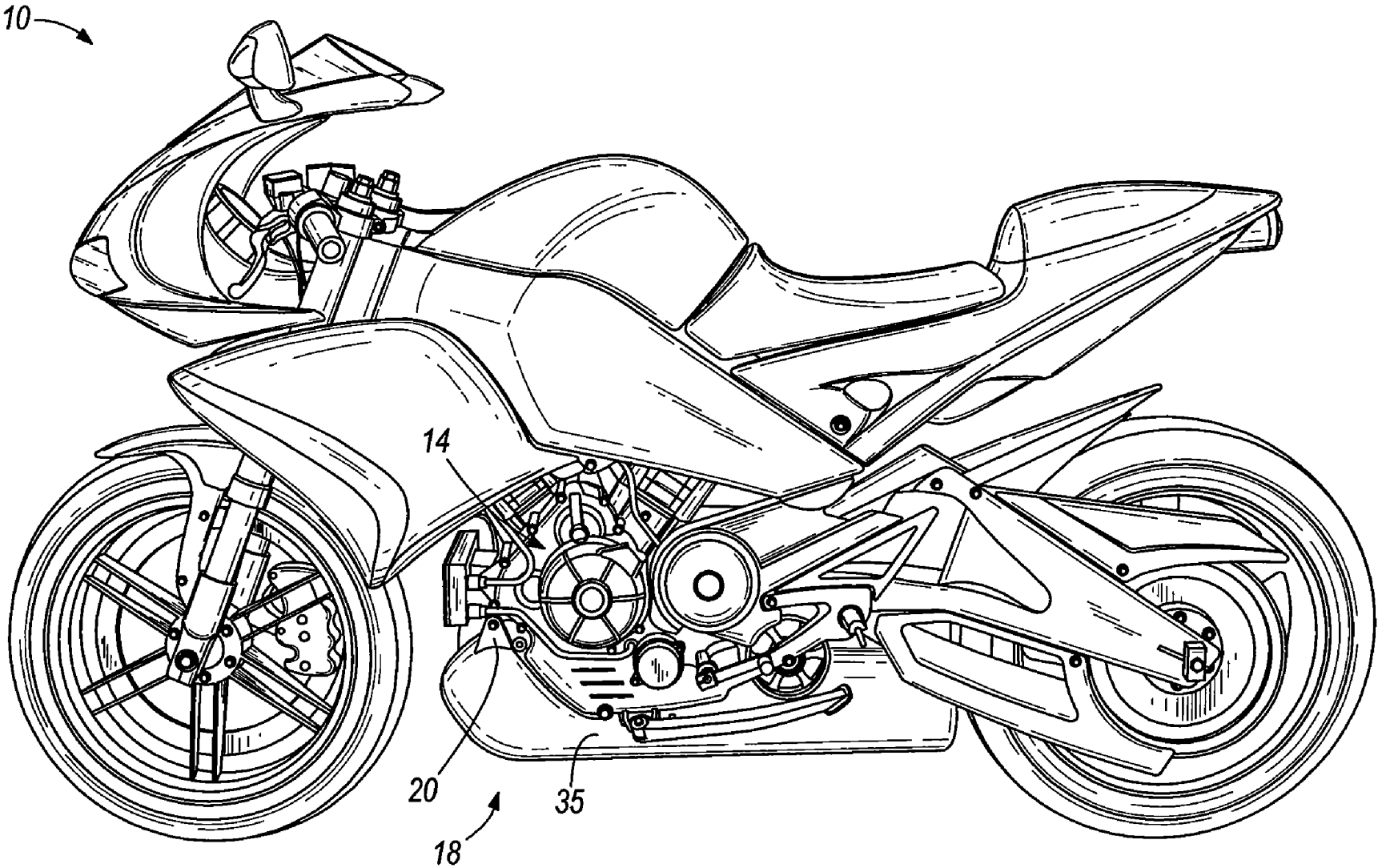
FIG. 1 is a side view of a motorcycle having an exhaust system embodying the present invention.

FIG. 1 illustrates a motorcycle 10 having a twin-cylinder engine 14. An air-fuel mixture is ignited in a combustion chamber (not shown) for each cylinder of the engine 14. Following combustion in a given combustion chamber, the exhaust gases (containing mixed products of the combustion reaction and some residual, un-reacted components) are expelled through an exhaust port into an exhaust system 18 of the motorcycle.

The exhaust system 18, as shown in FIGS. 1-4, includes brackets 20 for mounting to the motorcycle 10. The exhaust system 18 includes a pair of header pipes (i.e., "headers") 22, a collector section 26, a catalytic converter 30, and a sound-muffling section 34. The headers 22 are exhaust conduits leading directly from the engine 14. The collector section 26, catalytic converter 30, and sound-muffling section 34 collectively define a muffler assembly 35.

An upstream end 36A of each header 22 is coupled to the engine 14 to receive exhaust gases from a respective exhaust port of the engine 14. The headers 22 define exhaust flow passages that are separate from one another, each header 22 routing exhaust gases directly from an exhaust port of the engine 14 to a downstream exhaust component. A downstream end 36B of each of the headers 22 leads into an upstream end 35A of the muffler assembly 35, specifically, the collector section 26. The upstream end 35A of the muffler assembly 35 is positioned generally forward of the engine 14. The collector section 26 is an exhaust conduit defining a 2-into-1 exhaust flow passage joining the two separate exhaust flow passages of the headers 22 into a single, larger exhaust flow passage adjacent the catalytic converter 30. Therefore, exhaust gases from both combustion chambers are treated by the catalytic converter 30.

A connecting portion 35C of the muffler assembly 35 is coupled to the upstream end 35A to receive the exhaust gases from the upstream end 35A, routing the exhaust gases from in front of the engine 14 along the underside of the engine 14 to a downstream end 35B of the muffler assembly 35. The downstream end 35B, including the sound-muffling section 34, is coupled to the connecting portion 35C and positioned generally rearward of the engine 14. A casing 35D (made up of one or more pieces) extends from the upstream end 35A to the downstream end 35B, defining an outer surface of the muffler assembly 35.

From the catalytic converter 30, exhaust gases flow through a first passage of the connecting portion 35C to the sound-muffling section 34. As described above, the connecting portion 35C extends longitudinally underneath the engine, but alternate shaping and positioning of the exhaust components on the motorcycle 10 are optional. The exhaust gases pass through the sound-muffling section 34 (changing direction at least twice) before exiting the muffler assembly 35 at a pair outlets 35E, positioned at the downstream end 35B. In some embodiments, at least a portion of the exhaust gases flow back from the sound-muffling section 34 into the connecting portion 35C (into a resonator chamber, separate from the first passage of the connecting portion 35C) before exiting the muffler assembly 35 at the outlets 35E.

Returning now to the treatment of the exhaust gases at the upstream end 35A, the catalytic converter 30 improves the emissions quality of the exhaust gases expelled from the engine 14 with the use of one or more known catalyst materials (referred to hereinafter simply as catalyst 38), which are contained within the catalytic converter 30. The catalyst 38 reacts with undesirable exhaust gas components to produce more desirable products before being exhausted to the atmosphere via outlets 35E. Specifically, nitrogen oxides ($NO_x$) can be converted to nitrogen ($N_2$) and oxygen ($O_2$), while carbon monoxide (CO) can be converted to carbon dioxide ($CO_2$).

The temperature of the catalyst 38 affects its performance. It is necessary to warm-up, or "light off", the catalyst 38 above a minimum threshold temperature to obtain a desired level of performance from the catalytic converter 30 to effectively alter the undesirable exhaust gas components as described above. From a cold start of the engine 14, the catalyst 38 is generally below the minimum threshold temperature, and therefore it is desirable to heat up the catalyst as quickly as possible to obtain sufficient or optimal performance. One way to get quicker light off of the catalyst 38 is to place the catalytic converter 30 close to the engine 14, which is a source of heat via the hot exhaust gases flowing through the headers 22 to the catalytic converter 30.

However, placing the catalytic converter 30 at the downstream ends 36 of the headers can have an undesirable effect on the exhaust gas pressure dynamics as compared to a placement further downstream. The undesirable effect can be somewhat reduced by using multiple catalytic converters 30 in parallel. However, the use of multiple catalytic converters 30 causes an undesirable increase in catalyst light off time (in addition to increasing cost, size, and weight). Regardless of its position in the exhaust system 18, the catalyst 38 is a substantial obstruction in the flow passage and therefore, causes a sudden increase in flow resistance at its upstream end. This causes a positive pressure exhaust wave or pulse to be reflected back towards the engine 14 through the headers 22. The dynamics of the exhaust gases coming from the engine 14 and the reflected waves moving towards the engine impacts the engine performance (i.e., horsepower and torque output).

Under certain operating conditions, a reflected exhaust pulse hinders the exhaust scavenging process as well as the ability for the cylinder to become charged with fresh intake air (which can also affect the input of fuel into the cylinder). If the exhaust wave that is reflected off the catalyst 38 arrives at either combustion chamber during valve overlap (the time that both the intake and exhaust valves are open), there is a significant performance loss due to decreased volumetric efficiency. With high exhaust gas pressure downstream of the combustion chamber, the net pressure differential that draws fresh air into the cylinder is reduced. Hence, less air and fuel fills the cylinder, and volumetric efficiency is spoiled, resulting in a "hole" in horsepower and torque output. The reduced output occurs over the range of engine speeds where the positive exhaust wave returns during valve overlap. Generally, a longer distance between the cylinders and the catalyst 38 results in power loss at lower engine speeds, and a shorter distance between the cylinders and the catalyst 38 results in power loss at higher engine speeds.

Figure 2:
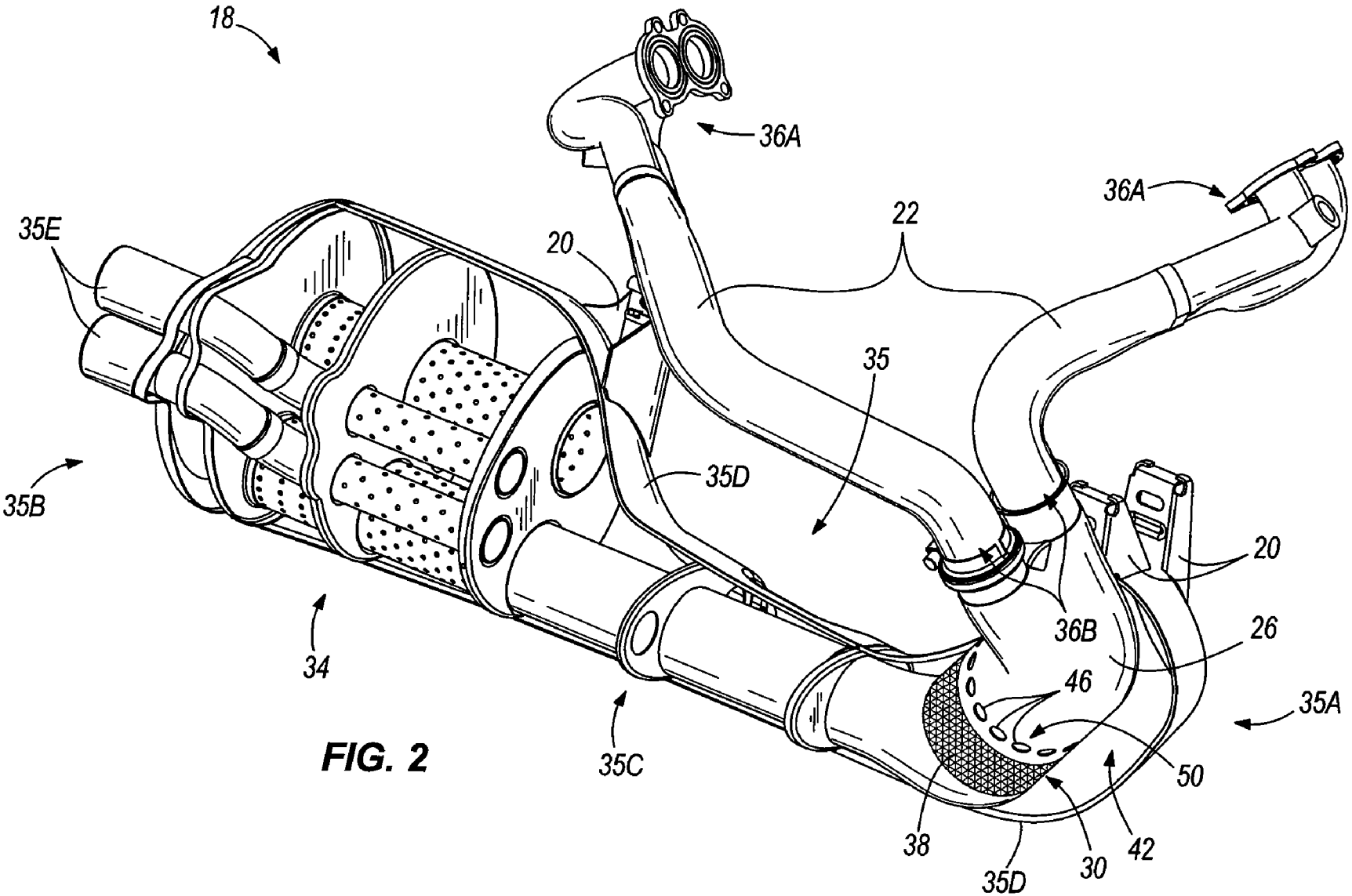
FIG. 2 is a partial cutaway perspective view of the exhaust system of FIG. 1.
Figure 3:
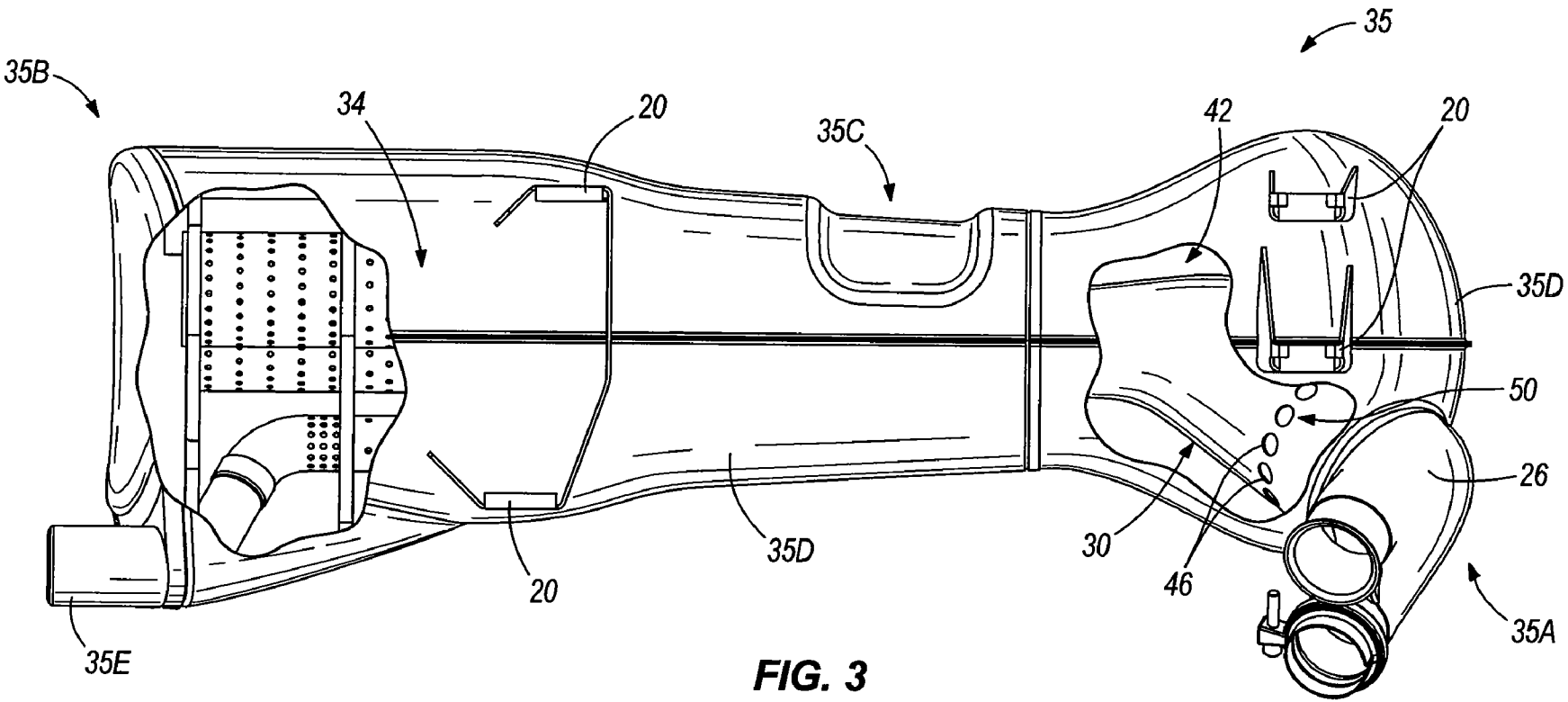
FIG. 3 is a partial cutaway top view of a muffler assembly of the exhaust system shown in FIG. 1.
Figure 4:
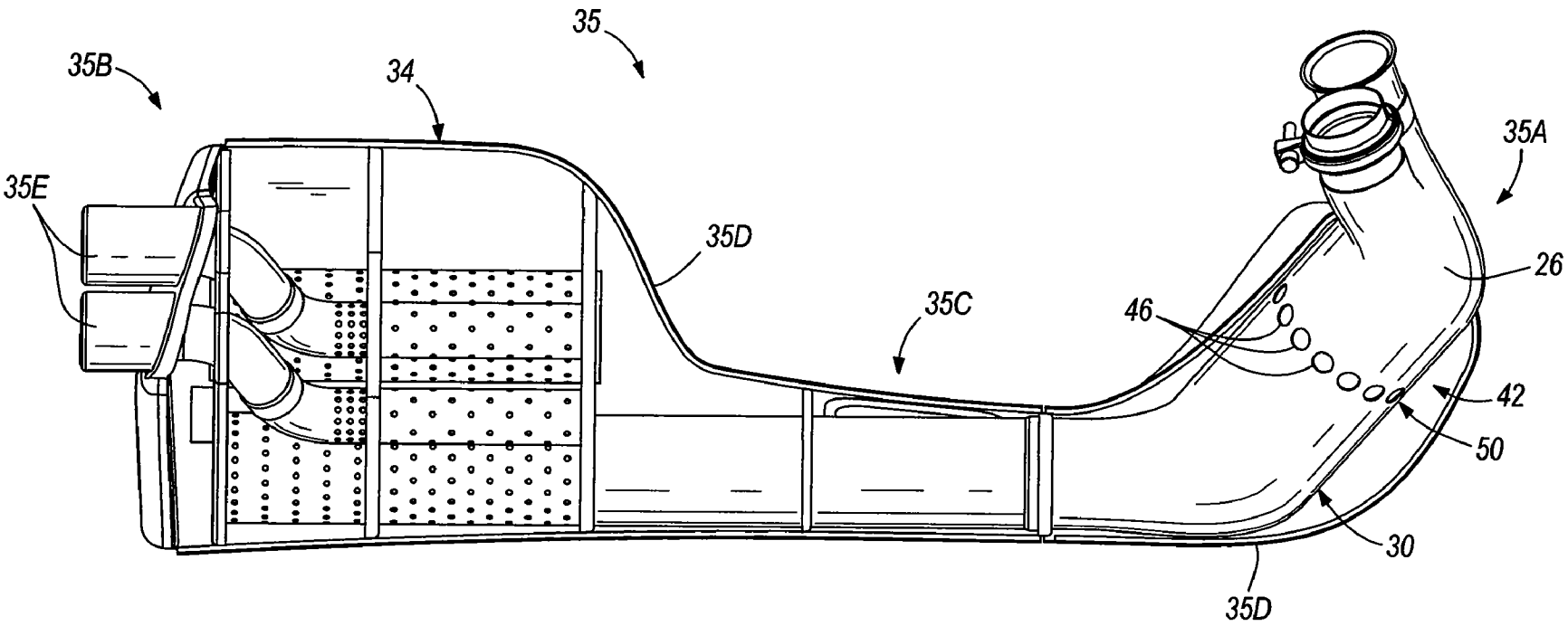
FIG. 4 is a partial cutaway side view of the muffler assembly of FIG. 1.

In the exhaust system 18, the catalytic converter 30 is positioned within the first half of the total exhaust gas flow length between the engine 14 and the outlets 35E. Furthermore, as shown in FIGS. 2-4, at least a portion of the collector section 26 is positioned within a resonator chamber 42. Furthermore, the resonator chamber 42 substantially surrounds or encloses the catalytic converter 30. In the illustrated embodiment, the catalytic converter 30 is entirely circumferentially enclosed within the resonator chamber 42 along the full length of the catalytic converter 30. In some embodiments, the resonator chamber 42 does not fully surround or enclose the catalytic converter 30, but rather is adjacent to or partially surrounding the catalytic converter 30. One or more apertures or openings 46 define a perforated section 50 fluidly coupling the exhaust flow passage of the collector section 26 with the resonator chamber 42, thus providing an expansion in the flow passage at the perforated section 50. As shown in FIGS. 2-4, the openings 46 are circular in shape and are equally-spaced around the circumference of the collector section 26. The openings 46 may have other shapes and/or other orientations in other embodiments.

The resonator chamber 42 serves a "dead end" expansion volume in that the only passageways into and out of the resonator chamber 42 are the openings 46. Thus, all the exhaust gases that enter the resonator chamber 42 through the openings 46 eventually flow out of the resonator chamber 42 through the openings 46 and subsequently pass through the catalytic converter 30. On the other hand, the exhaust gases that do not enter the resonator chamber 42 can pass directly into and through the catalytic converter 30. Flow into the catalytic converter 30 is unobstructed in that there are no physical obstructions to prevent exhaust flow straight from the headers 22 and through the catalytic converter 30, only the flow-restrictive nature of the catalytic converter 30, itself.

In the illustrated embodiment, the collector section 26 does not form a substantial length of the exhaust system 18. This is in contrast to an exhaust system with a long collector section, which typically runs from the front or alongside the engine to a location rearward of the engine. Rather, the collector section 26 of the illustrated exhaust system 18 serves to consolidate the exhaust gas flow passages of the headers 22 over a short length such that the perforated section 50 and the catalytic converter 30 are positioned at or substantially adjacent the downstream ends 36 of each of the headers 22 and within about the first 40% of the total flow length between the engine exhaust ports and the outlets 35E. For example, the length from the rear cylinder exhaust port to the perforated section 50 is about 612 millimeters, and the length from the perforated section 50 to the outlets 35E is about 950 millimeters.

The above description highlights some of the difficulties with simply taking a catalytic converter from a downstream location and moving it to a far upstream location for quicker light off. The resonator chamber 42 and the perforated section 50 of the present invention enable both quick light off and satisfactory power output of the engine 14.

When the exhaust valve (not shown) of one cylinder opens, a high pressure wave propagates down the associated header pipe 22. When this wave arrives at the perforated section 50, its pressure is dissipated by the expansion of the resonator chamber 42. A secondary wave (the remaining component of the original high pressure wave) is incident on the catalyst 38. A portion of the secondary wave of exhaust gases passes through the catalytic converter 30 to the muffler sound-muffling section 34. The portion of the secondary wave that does not go through the catalytic converter 30 is reflected off the catalyst 38 and back toward the engine 14. Before propagating to the upstream ends 36A of the headers 22, the pressure of the reflected wave is further diminished by expansion that occurs as the reflected wave encounters the perforated section 50. Therefore, the reflected wave that eventually makes it back toward the engine 14 is dissipated through expansions at the perforated section 50 (in addition to the portion which is passed through the catalytic converter 30). In addition to dissipation, a wave cancellation effect occurs under certain operating conditions and is tuned at least in part by the number of openings 46 and the size of the volume within the resonator chamber 42. In the occurrence of wave cancellation, two waves traveling in opposite directions are incident upon one another and at least one of the waves is cancelled out. For example, a wave of fresh exhaust gases from the engine 14 can cancel the effect of a reflected wave traveling from the collector section 26 toward the engine 14.

In the twin-cylinder engine 14 of the illustrated embodiment, in which both cylinders feed the single catalytic converter 30, the reflected wave off of the catalyst 38 is split at the collector section 26 and continues up both header pipes 22. In any exhaust configuration with multiple header pipes feeding a single catalytic converter, the reflected wave off of the catalyst is split at the collector among the header pipes. Therefore, the combination of the perforated section 50 and the resonator chamber 42 can deliver particularly good performance in twin-cylinder, shared exhaust setups, such as on the motorcycle 10 of FIG. 1. Although the exhaust system 18 is shown and primarily described for operation with a 2-into-1 setup, it is also useful for single-cylinder engines, and multi-cylinder engines with separated or shared exhaust systems.

Figure 5:
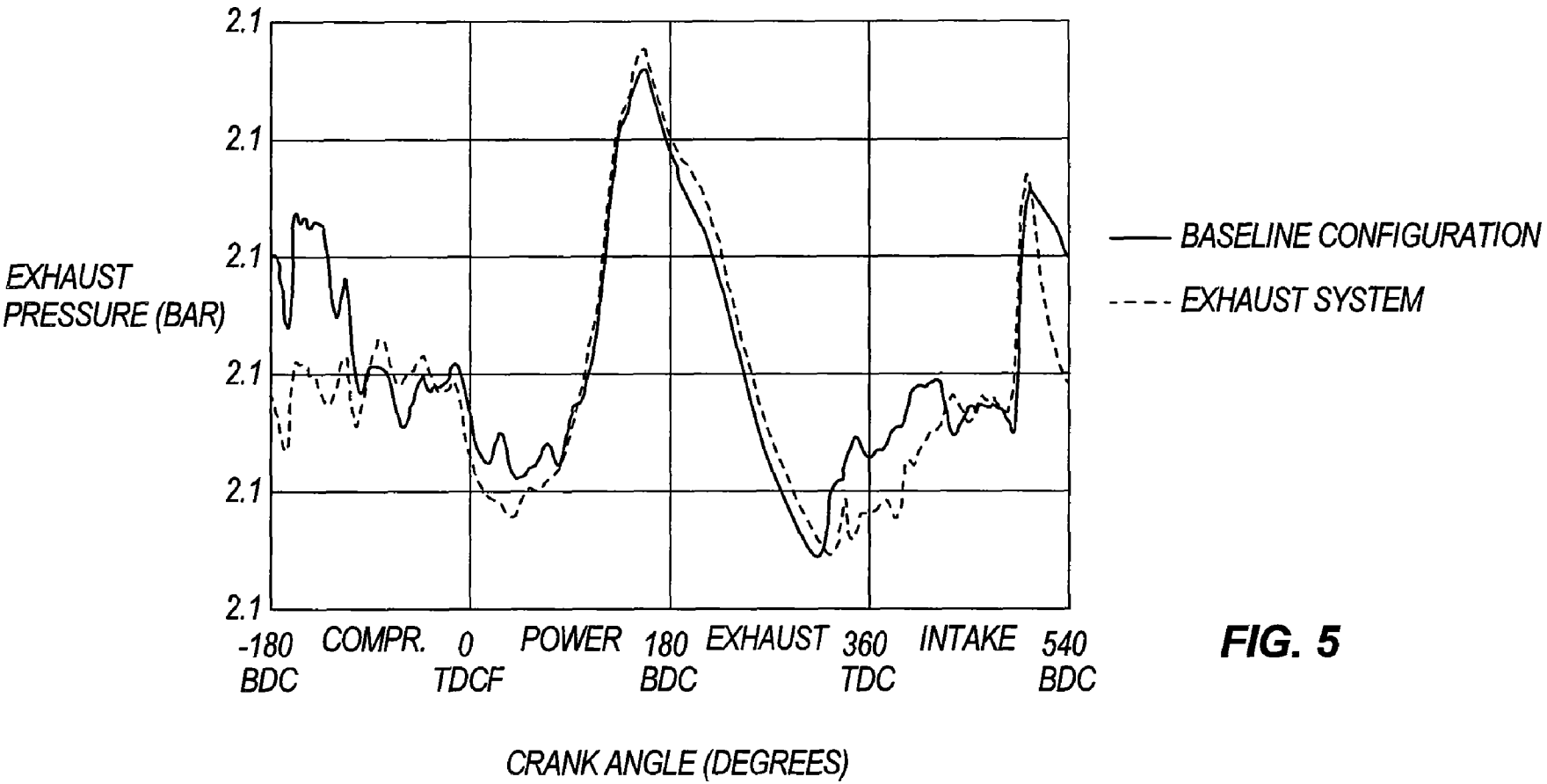
FIG. 5 is a graph representative of exhaust pressure versus crank angle illustrating the effect of the exhaust system of FIG. 1.
Figure 6:
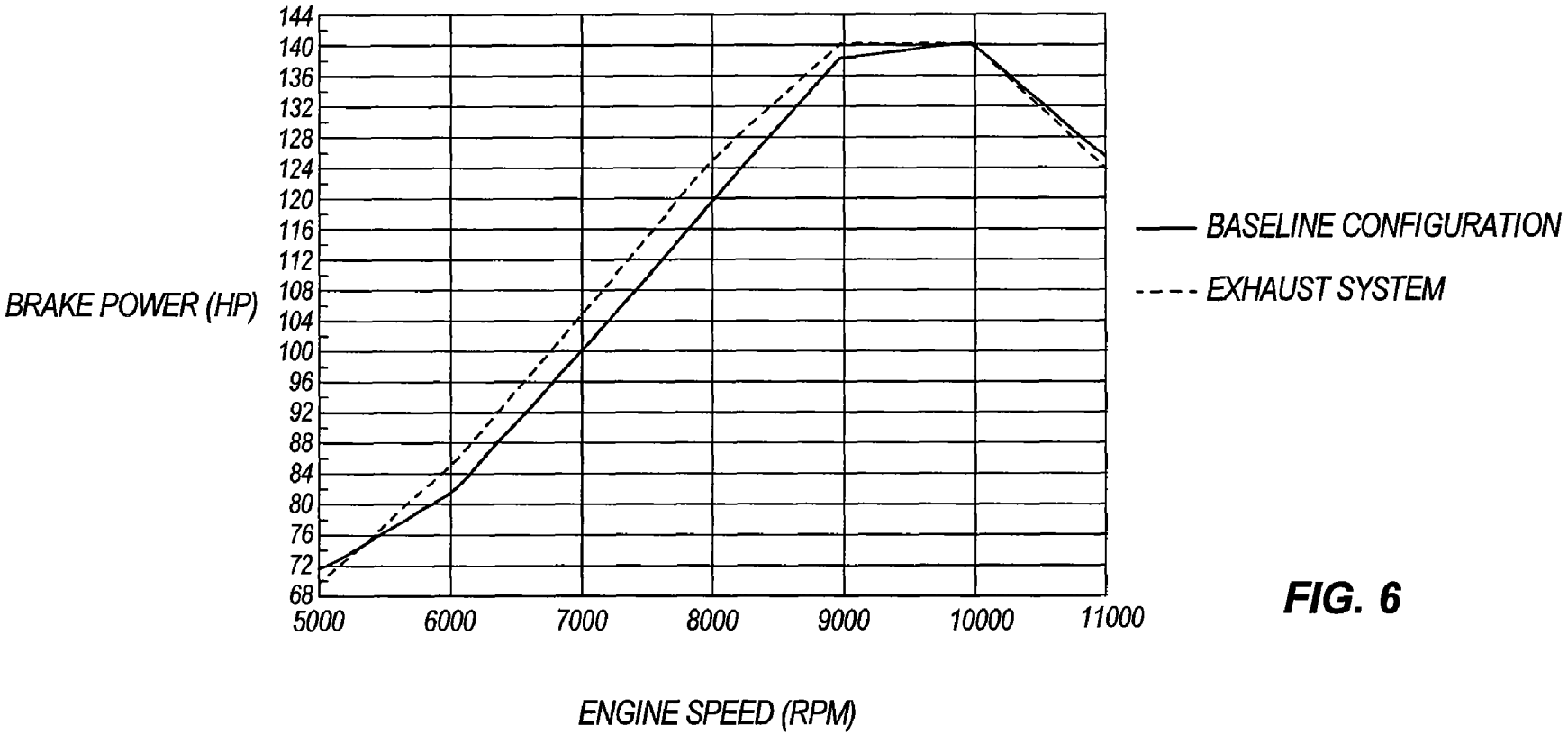
FIG. 6 is a graph representative of engine output versus engine speed illustrating the effect of the exhaust system.

FIGS. 5 and 6 illustrate the enhanced performance afforded by features of the exhaust system 18. FIG. 5 is a computer-simulated graph representative of exhaust pressure (at the port) versus crankshaft angle of the engine 14 while operating at a relatively high engine speed, such as 8000 RPM. One pressure plot in FIG. 5 is for a baseline configuration with a catalytic converter positioned similarly to the catalytic converter 30 in the muffler assembly 35 of the illustrated exhaust system 18. The baseline configuration, which is represented by a solid line, does not include the perforated section 50 or the resonator chamber 42, but is otherwise identical to the illustrated exhaust system 18. A second pressure plot in FIG. 5, indicated by the dashed line, is for the engine 14 with the exhaust system 18, including the perforated section 50 and the resonator chamber 42. The plots on the graph of FIG. 5 illustrate the effect of a reflected exhaust wave arriving at the exhaust port during valve overlap, generally around top dead center (TDC, 360 degrees as indicated in FIG. 5). The exhaust system 18 having the perforated section 50 and the resonator chamber 42 experiences a much lower exhaust pressure during valve overlap. The comparatively high exhaust pressure during valve overlap for the baseline configuration leads to decreased volumetric efficiency and decreased engine output as described above. Due to the location of the catalytic converter 30 adjacent the downstream ends 36 of the headers 22 (i.e., short exhaust length between the engine 14 and the catalyst 38), the reflected exhaust wave is present at the exhaust port during valve overlap at these relatively high engine speeds.

FIG. 6 is a computer-simulated graph illustrating the resulting power loss for an engine operating at speeds at which a reflected exhaust wave arrives at the exhaust port during valve overlap. The solid line on the graph of FIG. 6 represents the engine 14 with the theoretical baseline configuration described above, which serves as a basis for comparison. The dashed line represents the engine 14 with the illustrated exhaust system 18, including the perforated section 50 and the resonator chamber 42. Between 5500 rpm and 9000 rpm, the perforated section 50 and the resonator chamber 42 of the exhaust system 18 allow the engine to generate between 2 and 4 more horsepower. This represents up to about a 5 percent increase in power (measured at about 6000 rpm).

Figure 7:
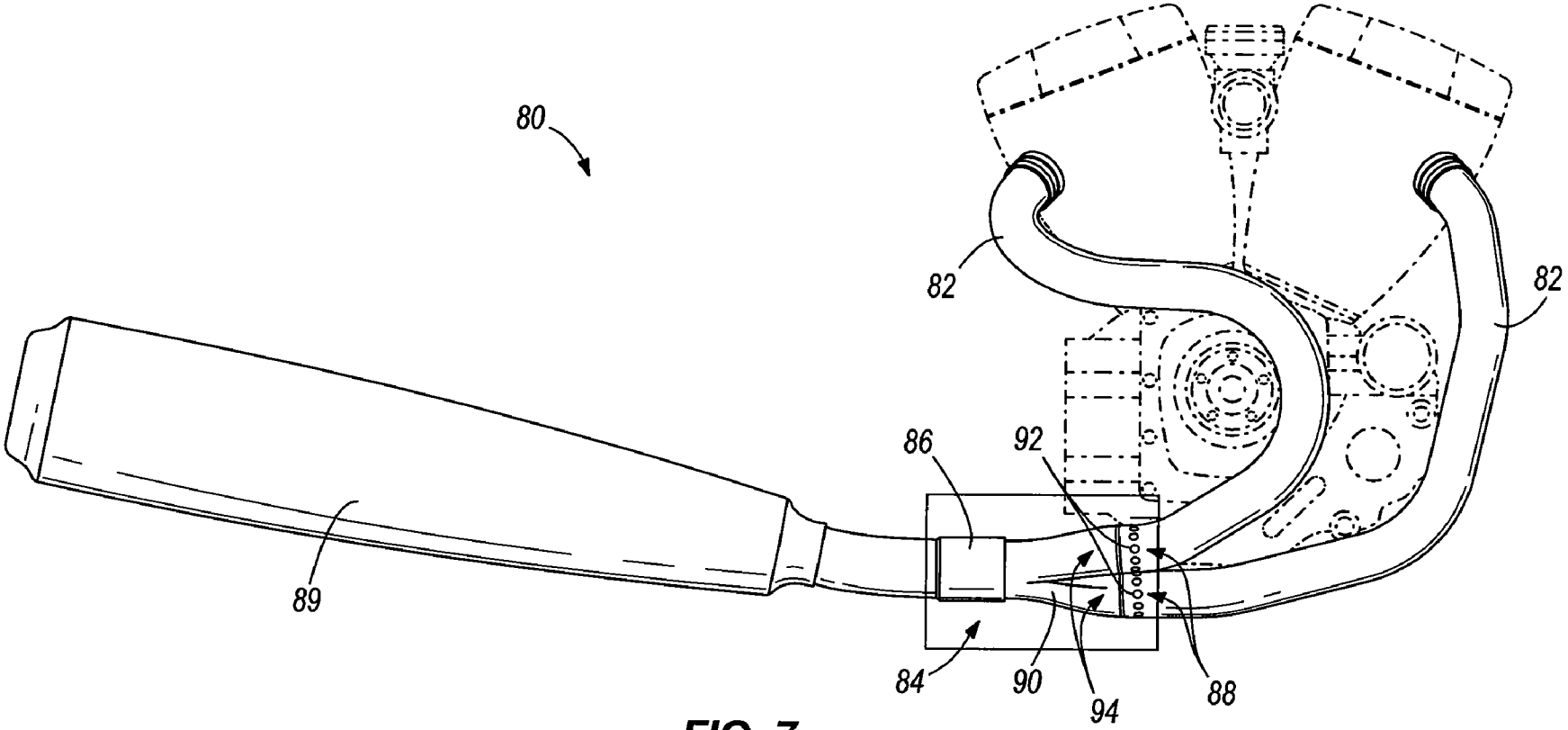
FIG. 7 is a schematic view of another construction of an exhaust system embodying some aspects of the present invention.

FIG. 7 illustrates another construction of an exhaust system 80 having a pair of headers 82, a resonator chamber 84, a catalytic converter 86, a perforated section 88 associated with each of the headers 82, and a sound-muffling portion 89. A collector section 90 combines two exhaust flow passages defined by the headers 82 into a single exhaust flow passage. The perforated sections 88 fluidly couple the header exhaust flow passages with an interior volume of the resonator chamber 84. The resonator chamber 84 is configured to surround the collector section 90, the perforated sections 88, and the catalytic converter 86. In alternate embodiments, the catalytic converter 86 is either positioned outside the resonator chamber 84 or positioned partially within the resonator chamber 84.

The perforated sections 88 are defined by one or more openings or apertures 92 in each of the headers 82. The openings 92 are circular and equally-spaced around circumferences of the headers 82 in the illustrated embodiment, but other shapes and orientations are possible. Although the exhaust system 80 of FIG. 7 differs from the exhaust system 18 of FIGS. 2-4 by positioning of the perforated sections 88 in the headers 82 rather than the single perforated section 50 in the collector section 26, the location of the perforated sections 88 with respect to the catalytic converter 86 is generally the same as in the exhaust system 18. Because the perforated sections 88 are positioned at the downstream ends of the headers 82 and because the collector section 90 does not span a considerable length, the catalytic converter 86 is immediately downstream of the perforated sections 88. The exhaust system 80 operates with the engine 14 to have similar operation and performance as the exhaust system 18 described above.

In addition to having two separate perforated sections 88, the exhaust system 80 of FIG. 7 differs from the exhaust system 18 of FIGS. 2-4 by being positioned substantially alongside the engine 14, rather than underneath the forward portion of the engine 14. The aspects of mounting to the side of the engine 14 and having two perforated sections 88 do not have to be incorporated together, but are both included in FIG. 7 for clarity. Either one of the design aspects of FIG. 7 can be incorporated with the exhaust system 18 of FIGS. 2-4 without the other.

The areas 94 indicated by the arrows in FIG. 7 represent alternate locations for the perforated sections 88. Rather than forming the openings 92 only in the headers 82, additional openings 92 may be formed in the collector section 90. This location of the perforated sections 88 is somewhat of a hybrid of the exhaust system 18 of FIGS. 2-4 and the exhaust system 80 of FIG. 7 in that there are multiple perforated sections 88 that are formed in the collector section 90.

What is claimed is:

1. An exhaust system for a motorcycle engine comprising:

a header having an upstream end adjacent a combustion chamber of the engine and having a downstream end opposite the upstream end;

a catalytic converter positioned downstream of the combustion chamber and configured to improve the emissions quality of exhaust gases discharged from the combustion chamber;

a perforated section at least partially defining an exhaust passageway, the perforated section disposed adjacent the downstream end of the header; and a resonator chamber in fluid communication with the perforated section, the resonator chamber configured to allow expansion of the exhaust gases in the exhaust passageway through the perforated section, wherein the perforated section of the exhaust passageway and at least a portion of the catalytic converter are surrounded by the resonator chamber.

2. The exhaust system of claim 1, wherein the catalytic converter, the perforated section, and the resonator chamber are part of a muffler assembly, and the catalytic converter is positioned at a forward end of the muffler assembly.

3. The exhaust system of claim 2, wherein the muffler assembly includes a sound-muffling section, and wherein the forward end is positioned in front of the engine and the sound-muffling section is positioned behind the engine.

4. The exhaust system of claim 1, wherein the catalytic converter is entirely enclosed within the resonator chamber.

5. The exhaust system of claim 1, further comprising:

a second header for directing exhaust gases away from a second combustion chamber of the engine; and a collector coupled between the first and second headers and the catalytic converter, wherein the perforated section is in the collector.

6. The exhaust system of claim 1, wherein the perforated section is in the header.

7. The exhaust system of claim 1, wherein the perforated section includes a plurality of spaced-apart apertures providing fluid communication between the exhaust passageway and the resonator chamber.

8. A motorcycle comprising:

an engine configured to expel exhaust gases from a combustion chamber while operating;

a header configured to direct the exhaust gases away from the combustion chamber, the header having an upstream end adjacent the combustion chamber and a downstream end remote from the combustion chamber;

a catalytic converter downstream of the combustion chamber and configured to improve the emissions quality of the exhaust gases;

a perforated section at least partially defining an exhaust passageway, the perforated section disposed adjacent the downstream end of the header; and a resonator chamber defining an expansion volume for the exhaust passageway adjacent the perforated section, wherein the perforated section of the exhaust passageway and at least a portion of the catalytic converter are surrounded by the resonator chamber.

9. The motorcycle of claim 8, wherein the catalytic converter, the perforated section, and the resonator chamber are part of a muffler assembly, and the catalytic converter is positioned at a forward end of the muffler assembly.

10. The motorcycle of claim 9, wherein the muffler assembly includes a sound-muffling section, and wherein the forward end of the muffler assembly is positioned in front of the engine and the sound-muffling section is positioned behind the engine.

11. The motorcycle of claim 8, wherein the catalytic converter is entirely enclosed within the resonator chamber.

12. The motorcycle of claim 8, further comprising:

a second header for directing exhaust gases away from a second combustion chamber of the engine; and a collector coupled between the first and second headers and the catalytic converter, wherein the perforated section is in the collector.

13. The motorcycle of claim 8, wherein the perforated section is in the header.

14. The motorcycle of claim 8, wherein the perforated section includes a plurality of spaced-apart apertures providing fluid communication between the exhaust passageway and the resonator chamber.

15. A muffler assembly for use with an engine, the muffler assembly having an upstream end for receiving exhaust gases from one or more headers and a downstream end for expelling exhaust gases to the atmosphere, the muffler assembly comprising:

a sound-muffling section adjacent the downstream end;

a catalytic converter having a quantity of catalyst capable of improving the emissions quality of the exhaust gases from the engine;

an exhaust conduit at least partially defining an exhaust passageway upstream of the catalytic converter, the exhaust conduit having one or more apertures; and a resonator chamber configured to allow volumetric expansion of the exhaust gases within the exhaust passageway, the resonator chamber in fluid communication with the one or more apertures, wherein the catalytic converter is positioned at the upstream end of the muffler assembly, and wherein the upstream end of the muffler assembly is positioned forward of the engine and the downstream end of the muffler assembly is positioned rearward of the engine, the muffler assembly having a connecting section fluidly coupling the catalytic converter and the sound-muffling section and positioned substantially under the engine.

16. The muffler assembly of claim 15, further comprising a unitary casing at least partially defining both the resonator chamber and the sound-muffling section.

17. The muffler assembly of claim 15, wherein the catalytic converter is at least partially enclosed within the resonator chamber.

18. The muffler assembly of claim 15, wherein the exhaust conduit includes a collector section fluidly coupling at least two headers with the catalytic converter.

19. The muffler assembly of claim 18, wherein the one or more apertures are positioned at a downstream end of the collector section adjacent the catalytic converter.

* * * * *